United States Patent [19]

Chibana

[11] 4,422,362

[45] Dec. 27, 1983

[54] ELECTRONIC MUSICAL INSTRUMENT OF A FORMANT SYNTHESIS TYPE

[75] Inventor: Masanobu Chibana, Hamamatsu, Japan

[73] Assignee: Nippon Gakki Seizo Kabushiki Kaisha, Hamamatsu, Japan

[21] Appl. No.: 300,993

[22] Filed: Sep. 10, 1981

[30] Foreign Application Priority Data

Sep. 19, 1980 [JP] Japan ..... 55-129164

[51] Int. Cl.[3] ..... G10H 1/06; G10H 7/00

[52] U.S. Cl. ..... 84/1.19; 84/1.2; 84/1.22; 84/1.24

[58] Field of Search ..... 84/1.01, 1.19–1.24

[56] References Cited

U.S. PATENT DOCUMENTS

| | | | |
|---|---|---|---|
| 4,018,121 | 4/1977 | Chowning | 84/1.01 |
| 4,135,422 | 1/1979 | Chibana | 84/1.01 |
| 4,253,367 | 3/1981 | Hiyoshi et al. | 84/1.22 |
| 4,301,704 | 11/1981 | Nagai et al. | 84/1.22 |

FOREIGN PATENT DOCUMENTS 55-18623 2/1980 Japan .

*Primary Examiner*—S. J. Witkowski

*Attorney, Agent, or Firm*—Spensley, Horn, Jubas & Lubitz

[57] ABSTRACT

A musical tone is synthesized by frequency modulation which realizes a desired fixed formant. A first accumulator repeatedly adds a constant corresponding to a center frequency of the fixed formant at a regular time interval to generate phase angle data of a carrier. A second accumulator repeatedly adds a constant corresponding to a fundamental frequency of a selected note at a regular time interval to output a carry out signal each time the accumulated value has exceeded a predetermined modulo number. By resetting the first accumulator repeatedly by this carry out signal, the phase angle data of the carrier is brought into a harmonic relation with the fundamental frequency. By effecting frequency modulation using this phase angle data of the carrier and the fundamental or harmonic frequency of a selected note, a musical tone in which harmonic components of the selected note are controlled in accordance with the desired fixed formant is synthesized. A third accumulator repeatedly adds a constant corresponding to a modulating frequency peculiar to the desired fixed formant at a regular time interval. Contents of the third accumulator are repeatedly reset by a carry out signal from the second accumulator. As a result, the output of the third accumulator is brought into a harmonic relation with the selected note and therefore is suitable for use as phase angle data of a modulating frequency in the frequency modulation.

15 Claims, 12 Drawing Figures

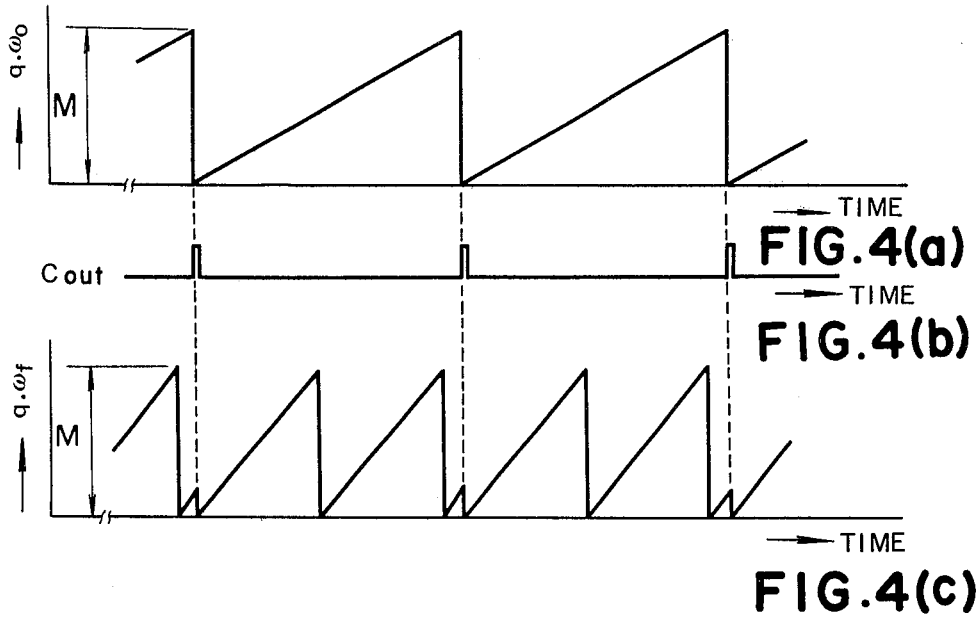
FIG.4(a)
FIG.4(b)
FIG.4(c)
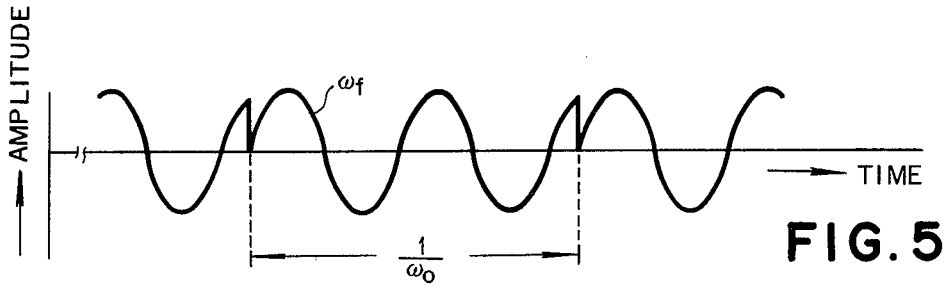
FIG.5
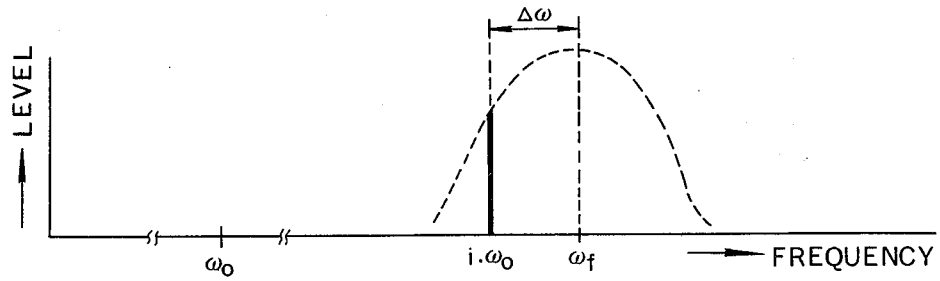
FIG.6

ELECTRONIC MUSICAL INSTRUMENT OF A FORMANT SYNTHESIS TYPE

BACKGROUND OF THE INVENTION

This invention relates to an electronic musical instrument capable of synthesizing a musical tone in accordance with a fixed formant by frequency modulation.

Natural musical instruments are known to have their own fixed formants peculiar to structures of the musical instruments such as a configuration of a sound-board in the case of a piano. A fixed formant exists in a human voice also and this fixed formant characterizes a tone color peculiar to a human voice. In order to simulate a tone color of a natural musical instrument or a human voice in an electronic musical instrument, a musical tone must be synthesized in accordance with a fixed formant peculiar to the tone color.

There have been proposed several methods of realizing a fixed formant in an electronic musical instrument. In these methods, one employing a frequency modulation computation is advantageous over other methods in respect of cost saving and simplification of structure. Prior arts relating to the present invention are listed up as follows:

a. U.S. Pat. No. 4,018,121 entitled "Method of Synthesizing a Musical Sound"

b. Japanese Patent Preliminary Publication No. 1980-18623 entitled "Electronic Musical Instrument"

The U.S. Pat. No. 4,018,121 discloses synthesizing of a tone of a desired spectrum structure by performing frequency modulation computation in an audio frequency range. The Japanese Patent Preliminary Publication No. 1980-18623 discloses synthesizing of a tone in accordance with an almost complete fixed formant by utilizing such frequency modulation computation.

In the electronic musical instrument of Japanese Patent Preliminary Publication No. 1980-18623, a formant is synthesized by conducting frequency modulation and using a frequency which is an integer multiple of a fundamental frequency designated by depression of a key as a carrier and the fundamental frequency as a modulating wave. In view of the fact that a center frequency of a fixed formant is not necessarily an integer multiple of a fundamental frequency of a depressed key, a harmonic frequency which is nearest to the formant center frequency is calculated and a formant having the calculated harmonic frequency as a central component is synthesized by frequency modulation, using the calculated harmonic frequency as a carrier. This necessitates a rather complicated computation circuit for determining a frequency which is nearest to the formant center frequency from among harmonic frequencies of the tone designated by the depression of the key (in other words, a converter for converting the formant center frequency to the nearest harmonic frequency). Conversion of the fixed formant center frequency to the nearest harmonic frequency is required for adjusting frequencies of the carrier wave and the modulating wave used in the frequency modulation computation to harmonic frequencies of a desired tone so that sidebands obtained by the frequency modulation will constitute harmonic component of this tone.

In the electronic musical instrument disclosed in the Japanese Patent Preliminary Publication No. 1980-19623, a formant which is more or less shifted from a desired fixed formant is synthesized if a center frequency of an original formant does not coincide with the nearest harmonic frequency. The amount of this shift poses a problem in a case where the fundamental frequency ($f_0$) of the depressed key is relatively high. An example of a spectrum envelope appearing in a case where the fundamental frequency ($f_0$) is low is shown in FIG. 1(*a*) whereas an example of a spectrum envelope appearing in a case where the fundamental frequency ($f_0$) is high is shown in FIG. 1(*b*). In each of these figures, a spectrum envelope of an object fixed formant to be synthesized is indicated by a solid line and a spectrum envelope of a formant which is actually synthesized by the prior art is indicated by a broken line. If the fundamental frequency ($f_0$) is low, interval of harmonic frequencies ($f_0$, $2f_0$, $3f_0$. . . ) is relatively narrow and, accordingly, differences between center frequencies ($f_{f1}$, $f_{f2}$) of desired fixed formants and harmonic frequencies ($3f_0$, $8f_0$) in the vicinity of the center frequencies ($f_{f1}$, $f_{f2}$) are not so large, as shown in FIG. 1(*a*), and differences between formants synthesized about the harmonic frequencies ($3f_0$, $8f_0$) and the desired fixed formants are of an insignificant amount. If, however, the fundamental frequency ($f_0$) is high, the interval of the harmonic frequencies ($f_0$, $2f_0$, $3f_0$. . . ) is so wide that, as shown in FIG. 1(*b*), differences between the center frequencies ($f_{f1}$, $f_{f2}$) of desired fixed formants and the harmonic frequencies ($f_0$, $2f_0$) in the vicinity thereof are widened and formants synthesized about the harmonic frequencies ($f_0$, $2f_0$) are shifted from the desired fixed formants to a large extent resulting in deterioration in tone quality of a produced tone. For example, an original level of the harmonic frequency $2f_0$ shown in FIG. 1(*b*) is $l_0$ but the level of the frequency becomes L which is much higher than $l_0$ due to shifting of the formant as indicated by the broken line with a result that the desired tone color cannot be obtained. For eliminating this disadvantage in the prior art, a level correction circuit must be additionally provided to correct the error in the signal level produced by the shifting of formant. This level correction circuit has to be of complicated construction for detecting frequency difference between the formant center frequency and the nearest harmonic frequency and applying a suitable level correction in accordance with the detected frequency difference.

SUMMARY OF THE INVENTION

It is an object of the present invention to produce, in an electronic musical instrument of a type in which formant is synthesized by frequency modulation, a carrier signal of a frequency which is in a harmonic relation with a fundamental frequency of a tone to be produced and located in the vicinity of a formant center frequency in a state in which it is corrected in level in accordance with frequency difference from the formant center frequency, without requiring the complicated circuit for calculating a harmonic frequency which is nearest to the formant center frequency and the above described level correction circuit employed in the prior art devices.

This object is achieved by generating, as phase angle data of a carrier, data which repeats increase (or decrease) at a predetermined modulo number corresponding to a phase $2\pi$ by repeatedly adding (or subtracting) data representing a phase angle increment (or decrement) of a center frequency of a desired formant and periodically resetting this successively changing phase angle data to a predetermined phase angle value (e.g., an initial phase) in synchronism with a fundamental frequency of a desired note. A tone is synthesized by establishing a carrier signal in accordance with this phase angle data and frequency modulating this carrier signal by a modulating wave signal corresponding to the frequency of the desired note.

The fundamental frequency of the desired note used for periodically resetting the phase angle data of the carrier is lower than the formant center frequency. Accordingly, the carrier signal established by this phase angle data contains the fundamental frequency of the desired note as the lowest frequency component (i.e., fundamental component) and frequency components which are integer multiples of the fundamental frequency. Besides, the level of a frequency component which is nearest to the formant center frequency among the frequency components contained in the carrier signal is emphasized to the furthest degree. As will be apparent from analysis of the periodical resetting with respect to the phase angle data as an analogy of a repeated multiplication of a time window function relative to a sinusoidal wave signal as will be described later, the carrier signal established by this phase angle data is a signal containing frequencies which are integer multiples of the fundamental frequency used for the resetting operation and whose levels are determined by a predetermined spectrum envelope having the formant center frequency as its apex. In other words, a carrier signal is obtained as a signal in which the level of a harmonic frequency which is nearest to a center frequency of a desired formant is emphasized to the furthest degree in accordance with a frequency difference from the center frequency. In this manner, a carrier signal is produced by a simple resetting operation as a signal which is in harmonic relation with a fundamental frequency of a tone, the level of a harmonic frequency which is nearest to a formant center frequency among harmonic components of the signal is emphasized to the furthest degree and the level is automatically corrected in accordance with a frequency difference from the formant center frequency.

It is another object of the invention to eliminate the following disadvantage occurring in the synthesis of a formant by frequency modulation by a device of simple construction; If a modulating frequency $\omega_m$ (frequency of a selected note) is relatively high, a formant obtained is widened as shown in FIG. 2(*b*), which is of a quite different shape from a desired formant shown in FIG. 2(*a*). This is because the level of sidebands obtained by frequency modulation is determined by Bessel's function regardless of a modulating frequency. For example, levels of primary sidebands $\omega_c \pm \omega_m$ shown in FIGS. 2(*a*) and 2(*b*) are of the same height determined by Bessel's function regardless of the magnitude of the modulating frequency $\omega_m$. It is possible to overcome this problem by controlling modulation index in accordance with a value of the modulating frequency $\omega_m$, but this requires a very complicated circuit construction. In the present invention, the above described object is achieved by previously providing data representing an ideal modulating frequency for synthesizing a desired formant by frequency modulation, generating data which repeates increase (or decrease) at a predetermined modulo number corresponding to a phase angle $2\pi$ as phase angle data of a modulating wave by repeatedly adding (or subtracting) the ideal data, and periodically resetting this successively changing phase angle data to a predetermined phase angle value (e.g. an initial phase) in synchronism with a fundamental frequency of a desired note. The modulating wave signal established by this phase angle data contains frequencies which are integer multiples of the fundamental frequency and whose levels are determined by a predetermined spectrum envelope having the ideal modulating frequency as its apex. In other words, a modulating wave signal in which a harmonic frequency component nearest to the ideal modulating frequency is emphasized to the furthest degree is obtained. Since a principal component of the modulating wave signal obtained in this manner is located in the vicinity of the ideal modulating frequency, the modulating wave signal is not affected by a large variation of a fundamental frequency so that it can contribute to synthesis of an ideal formant of a constantly uniform shape.

BRIEF DESCRIPTION OF THE DRAWINGS

In the accompanying drawings

FIGS. 4(*a*) to 4(*c*) are diagrams showing an example of the output of an accumulator of FIG. 3;

FIG. 5 is a waveform diagram showing an example of phase angle data of a carrier obtained in the circuit of FIG. 3 converted to a sinusoidal wave;

FIG. 6 is a spectrum diagram for explaining spectrum components of the waveform shown in FIG. 5;

DESCRIPTION OF PREFERRED EMBODIMENTS

Figure 1A:
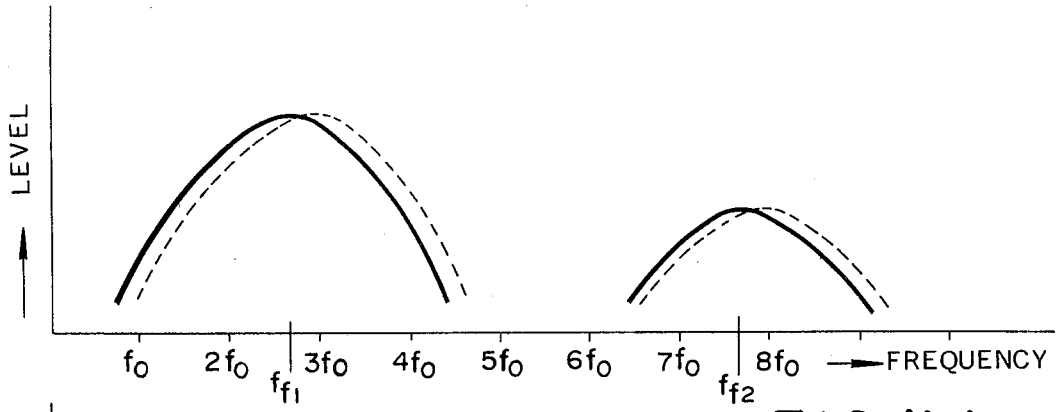
FIG. 1(a) PRIOR ART
FIGS. 1(*a*) and 1(*b*) are spectrum envelope diagrams for explaining frequency difference between a fixed formant synthesized by the prior art device and an original fixed formant.
Figure 1B:
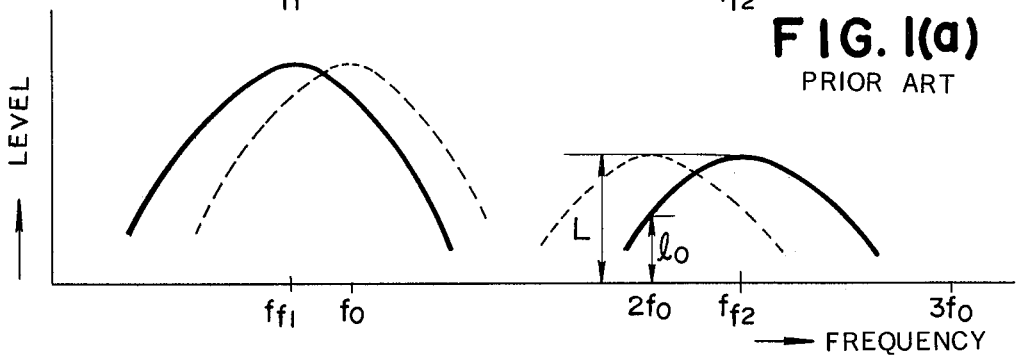
FIG. 1(b) PRIOR ART
Figure 2A:
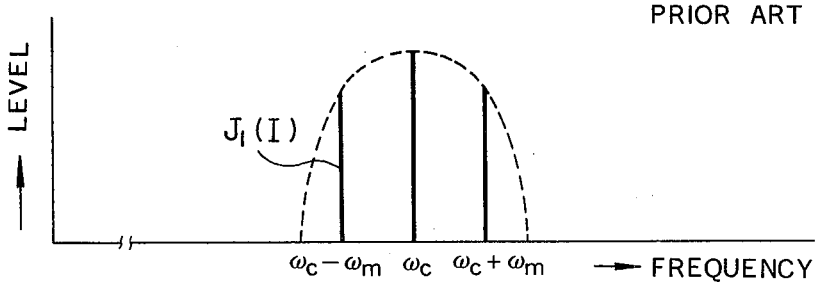
FIG. 2(a) PRIOR ART
FIGS. 2(*a*) and 2(*b*) are spectrum envelope diagrams for explaining problems in the prior art device for synthesizing a formant by frequency modulation.
Figure 2B:
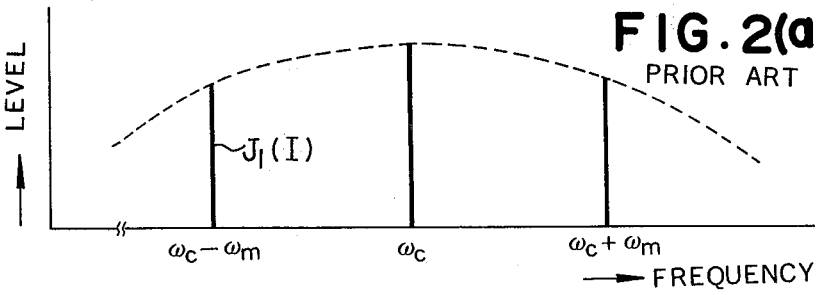
FIG. 2(b) PRIOR ART
Figure 3:
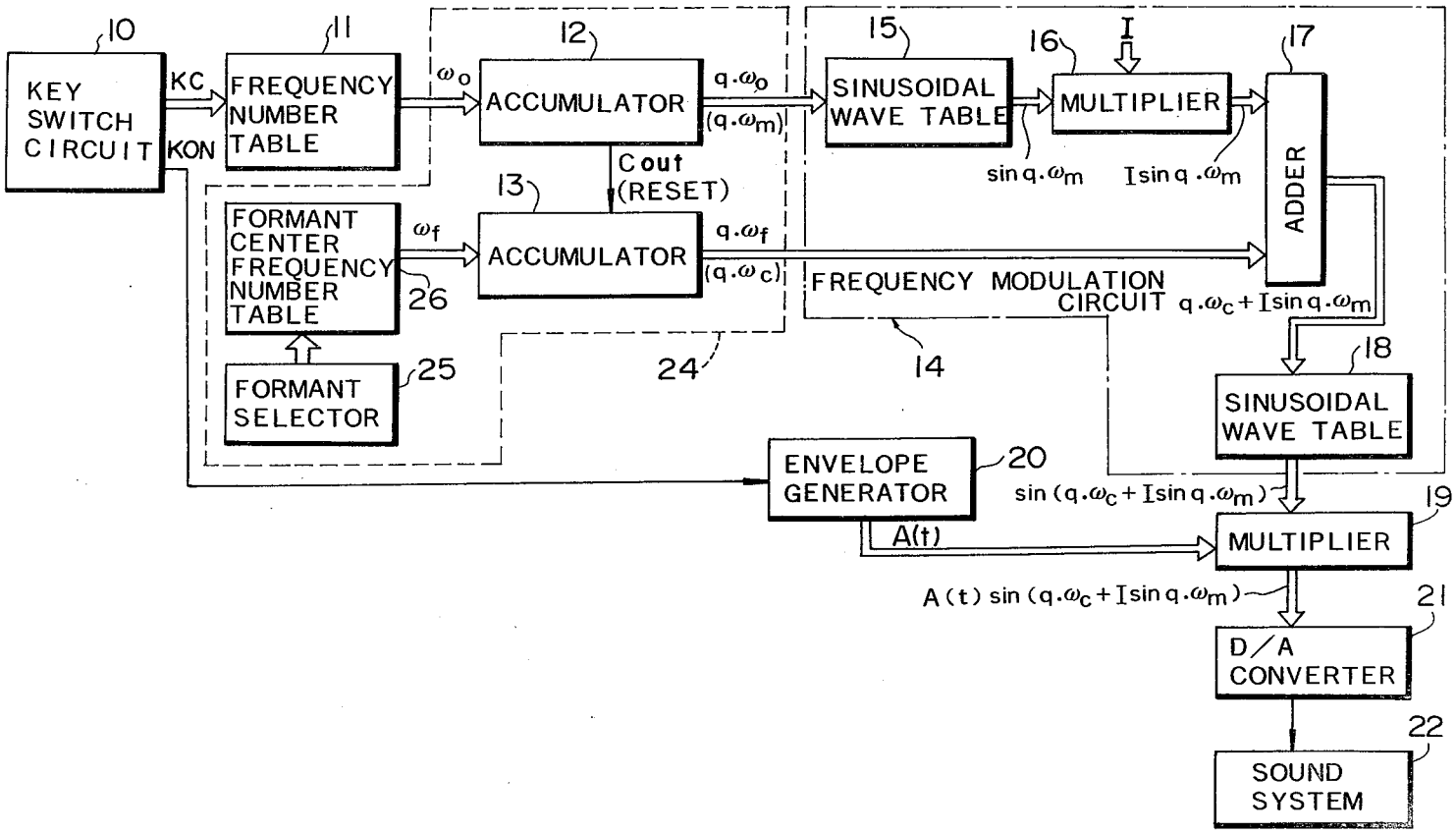
FIG. 3 is a block diagram showing an embodiment of the invention.

Referring to FIG. 3, a key switch circuit 10 outputs a key code KC representing a key being depressed in a keyboard (not shown) and also a key-on signal KON in response to depression of the key. The key code KC is applied to an address of a frequency number table 11 to enable the table 11 to read out frequency number $\omega_0$ which is a numerical value corresponding to a fundamental frequency of a note designated by the depressed key. As is already known, this frequency number $\omega_0$ represents a phase increment (or decrement) per unit time for obtaining a desired fundamental frequency. The unit time is an interval of computation time in an accumulator 12. The frequency number $\omega_0$ is repeatedly and cumulatively added in the accumulator 12 at a regular time interval and an accumulated value $q.\omega_0$ is outputted from the accumulator 12. The reference character q denotes an integer representing times of the repeated addition which increases 1, 2, 3, . . . as time goes by. As is well known, the accumulator has a predetermined modulo number corresponding to a phase angle $2\pi$ so that each time the accumulated value $q.\omega_0$ has reached (or exceeded) the modulo number, the value $q.\omega_0$ is reduced to a value which is left after subtracting the modulo number. Accordingly, the accumulated value $q.\omega_0$ is a periodical function repeating increase to a maximum value which is the modulo number corresponding to the phase angle $2\pi$. The accumulated value at each instant represents a phase angle at that instant and, accordingly, constitutes phase angle data of a fundamental frequency of a note designated by a depressed key. In the present embodiment in which the fundamental frequency of the depressed key is used for a modulating frequency in the frequency modulation, the accumulated value $q.\omega_0$ outputtted by the accumulator 12 is utilized as phase angle data $q.\omega_0$ of a modulating wave signal.

Each time the accumulated value $q.\omega_0$ has reached (or exceeded) a predetermined modulo number in the accumulator 12, a carry out signal Cout is outputted from the accumulator 12. This carry out signal Cout is applied to a reset input of an accumulator 13.

The accumulator 13 repeatedly adds data $\omega_f$ representing a center frequency of a desired formant (a fixed value corresponding to the desired formant) at a regular time interval. This data $\omega_f$, like the frequency number $\omega_0$, is data representing a phase increment per unit time for obtaining the center frequency of the desired formant. This data $\omega_f$ is read from a formant center frequency number table 26 in accordance with a formant selected by a formant selector 25. Phase angle data $q.\omega_f$ is obtained by repeatedly adding this data $\omega_f$ in the accumulator 13. The accumulator 13, like the accumulator 12, has a predetermined modulo number corresponding to a phase angle $2\pi$ and each time the accumulated value $q.\omega_f$ has reached (or exceeded) the modulo number, the accumulated value $q.\omega_f$ is reduced to a value which is left after subtracting the modulo number. Accordingly, phase angle data $q.\omega_f$ which repeates increase to a maximum value which is the modulo number corresponding to the phase angle $2\pi$ and whose frequency of repetition corresponds to the center frequency of the desired formant is theoretically produced by the accumulator 13. Since, however, the accumulator 13 is periodically reset by the carry out signal Cout provided by the accumulator 12, the phase angle data $q.\omega_f$ which is actually obtained is not a simple periodical function.

This will be further explained with reference to FIGS. 4(*a*) to 4(*c*). FIG. 4(*a*) shows the accumulated value $q.\omega_0$ in the accumulator 12. In the figure, the horizontal axis indicates time and the vertical axis the accumulated value. This accumulated value $q.\omega_0$ repeates increase periodically within a range of a modulo number M. Each time the accumulated value $q.\omega_0$ has exceeded the modulo number M, a carry out signal Cout is outputted as shown in FIG. 4(*b*). On the other hand, the accumulated value $q.\omega_f$ of the accumulator 13 repeats increase within a range of the modulo number M until an instant immediately before generation of the carry out signal Cout as shown in FIG. 4(*c*) and, upon generation of the carry out signal Cout, the accumulated value $q.\omega_f$ is compulsorily reset even if it has not reached the modulo number M yet.

Accordingly, the frequency components contained in the phase angle data $q.\omega_f$ outputted by the accumulator 13 do not simply coincide with the formant center frequency $\omega_f$. By resetting the accumulated value $q.\omega_f$ periodically to a predetermined phase (e.g. an initial phase) in synchronism with the fundamental frequency $\omega_0$ which is lower than the formant center frequency $\omega_f$, the phase angle data $q.\omega_f$ contains frequency components which are integer multiples of the fundamental frequency $\omega_0$ and the level of one of these frequency components which is nearest to the formant center frequency $\omega_f$ is emphasized to the furthest degree in accordance with a frequency difference from the center frequency $\omega_f$. The reason for this will be described below.

If the phase angle data $q.\omega_f$ shown in FIG. 4(*c*) is substituted by a sinusoidal wave, the substituted wave will be as shown in FIG. 5. the waveform shown in FIG. 5 is repetition of a sinusoidal wave of the frequency $\omega_f$ multiplied by a time window with a time width of $1/\omega_0$. Alternatively stated, a waveform obtained by selecting a sinusoidal wave of the frequency $\omega_f$ within the time width $1/\omega_0$ is repeatedly produced with a frequency of $\omega_0$. Spectrum of the waveform as shown in FIG. 5 is known to become as shown in FIG. 6. A spectrum envelope of such waveform has a shape having its apex at the frequency $\omega_f$ of the sinusoidal wave and spectrum components determined by this spectrum envelope appear at frequencies $(i.\omega_0)$ (where $i=1, 2, 3 \ldots$) which are integer multiples of the repetition frequency $\omega_0$ of the time window $1/\omega_0$. Accordingly the level of a harmonic frequency $i.\omega_0$ which is nearest to the sinusoidal wave, i.e., the formant center frequency $\omega_f$ is emphasized to the furthest degree. The shape of this spectrum envelope does not change even if the time width $1/\omega_0$, i.e., the fundamental frequency $\omega_0$ of the depressed key changes. The level of the nearest harmonic frequency component $i.\omega_0$ ( and other harmonic frequency components alike) therefore is automatically controlled in accordance with difference $\Delta\omega$ between the center frequency $\omega_f$ of the spectrum envelope and the nearest harmonic frequency $i.\omega_0$.

Consequently, by synthesizing (solely or by synthesizing it with other waveform components) a sinusoidal wave corresponding to the phase angle data $q.\omega_f$ provided by the accumulator 13, spectrum components produced by this pahse angle data $q.\omega_f$ becomes of the same shape as shown in FIG. 6. For the reason stated above, the periodical function established by the phase angle data $q.\omega_f$ outputted by the accumulator 13 is in a harmonic relation with the fundamental frequency $\omega_0$ of the depressed key and the level of a harmonic frequency $i.\omega_0$ nearest to the formant center frequency $\omega_f$ is most emphasized and is automatically corrected in accordance with difference of the harmonic frequency from the center frequency $\omega_f$. Since the phase angle data $q.\omega_f$ is equipped with all conditions required for a carrier signal in synthesizing a formant by frequency modulation as will be apparent from the above description, this data $q.\omega_f$ is utilized directly in a frequency modulation circuit 14 as phase angle $q.\omega_c$ of the carrier signal.

The frequency modulation circuit 14 is provided for implementing frequency modulation on the basis of the phase angle data $q.\omega_m$ (i.e., $q.\omega_0$) of a modulating wave outputted by the accumulator 12 and the phase angle data $q.\omega_c$(i.e., $q.\omega_f$) of a carrier outputted by the accumulator 13. The phase angle data $q.\omega_m$ of the modulating wave is applied to an address of a sinusoidal wave table 15 which reads out sinusoidal wave amplitude data $\sin q.\omega_m$ in accordance with the phase angle. In a multiplier 16, the amplitude data $\sin q.\omega_m$ read from the table 15 is multiplied by modulation index I. As to the modulation index I and the previously described formant center frequency $\omega_f$, values corresponding to a desired formant are read from a formant parameter generation circuit (not shown) composed of a suitable device such as a read-only memory in accordance with selection of the desired formant by a formant selector 25. The shape of the spectrum envelope of the formant is determined by this modulation index I.

The output I sin q.$\omega_m$ of the multiplier 16 is applied to an adder 17 where it is added with the phase angle data q.$\omega_c$ of the carrier. The result of addition (q.$\omega_c$+I sin q.$\omega_m$) is applied to an address of a sinusoidal wave table 18 as phase angle data and sinusoidal wave amplitude data sin (q.$\omega_c$+I sin q.$\omega_m$) corresponding to the phase angle is read from the table 18. In this manner, a signal sin (q.$\omega_c$+I sin q.$\omega_m$) which is a result of frequency modulating the carrier signal represented by the phase angle data q.$\omega_c$ by the modulating wave signal represented by the phase angle data g.$\omega_m$ is obtained from the sinusoidal wave table 18. This frequency modulated signal sin (q.$\omega_c$+I sin q.$\omega_m$) includes a plurality of sideband waves which are in harmonic relation with the fundamental frequency $\omega_0$ of the depressed key and generated in accordance with a formant having as its central component the harmonic frequency i.$\omega_0$ nearest to the center frequency $\omega_f$ of the desired formant. This frequency modulated signal is also corrected in its level in acordance with difference between the harmonic frequency i.$\omega_0$ which constitutes the central component of the formant and the original center frequency $\omega_f$.

The frequency modulated signal sin (q.$\omega_c$+I sin q.$\omega_m$) outputted by the sinusoidal table 18 is supplied to a multiplier 19 where it is controlled in its amplitude with lapse of time by an envelope signal A(t) provided by an envelope generator 20. The envelope generator 20 generates the envelope signal A(t) which has attack, sustain and decay portions in response to the key-on signal KON provided by the key switch circuit 10. The signal A(t) sin (q.$\omega_c$+I sin q.$\omega_m$) having been controlled in amplitude is converted to an analog tone signal by a digital-to-analog converter 21 and thereafter is supplied to a sound system 22 for sounding of a tone.

Figure 7:
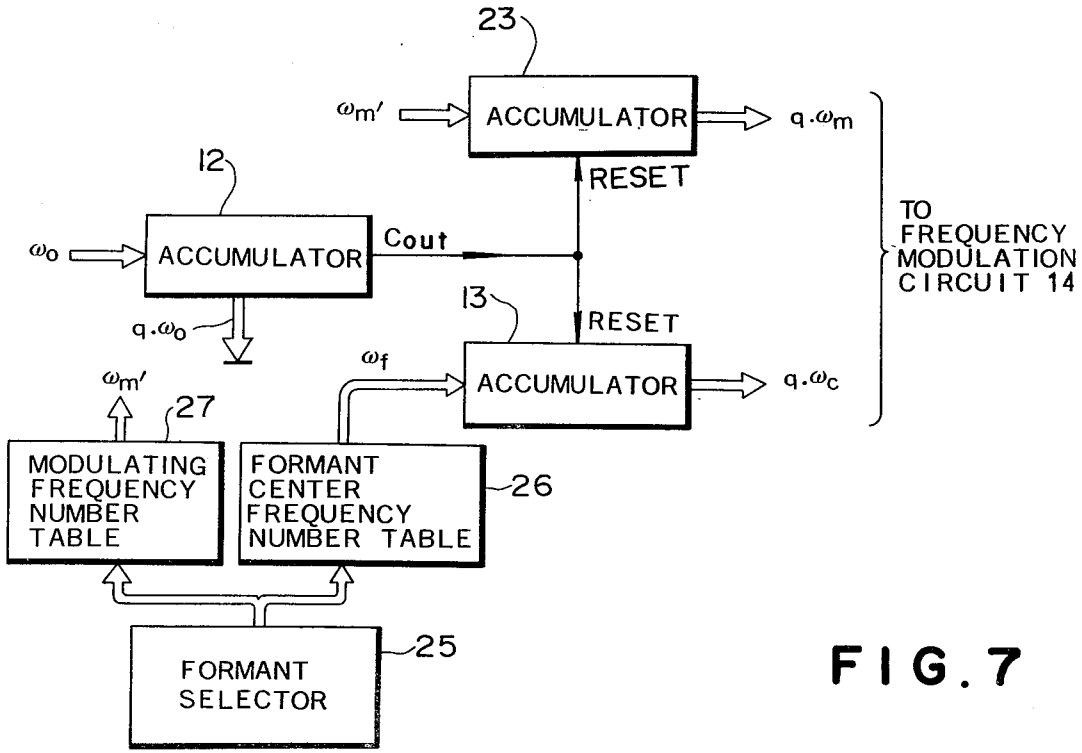
FIG. 7 is a block diagram showing another embodiment of the invention, modified portions in FIG. 3 only being illustrated.

Another embodiment of the invention will now be described with reference to FIG. 7. FIG. 7 shows an improvement of a portion 24 enclosed by a broken line in the embodiment of FIG. 3. In this embodiment, data $\omega_m'$ which represents an ideal modulating frequency in realizing a desired fixed formant by frequency modulation is previously provided aside from the data $\omega_f$ which represents the formant center frequency. This data $\omega_m$ represents a phase increment per unit time corresponding to the ideal modulating frequency (which is a fixed frequency according to the desired formant). This data $\omega_m'$ is read from a modulating frequency number table 27 in accordance with a formant selected by a formant selector 25. An accumulator 23 repeates addition of this data $\omega_m'$ to provide accumulated data q.$\omega_m$ representing a phase angle of the modulating wave signal. The accumulator 23, like the accumulators 12 and 13 is of modulo corresponding to the phase angle $2\pi$ and each time the accumulated value q.$\omega_m$ has reached or exceeded the modulo number, the accumulated value q.$\omega_m$ is reduced to a value left after subtracting the modulo number.

Figure 8:
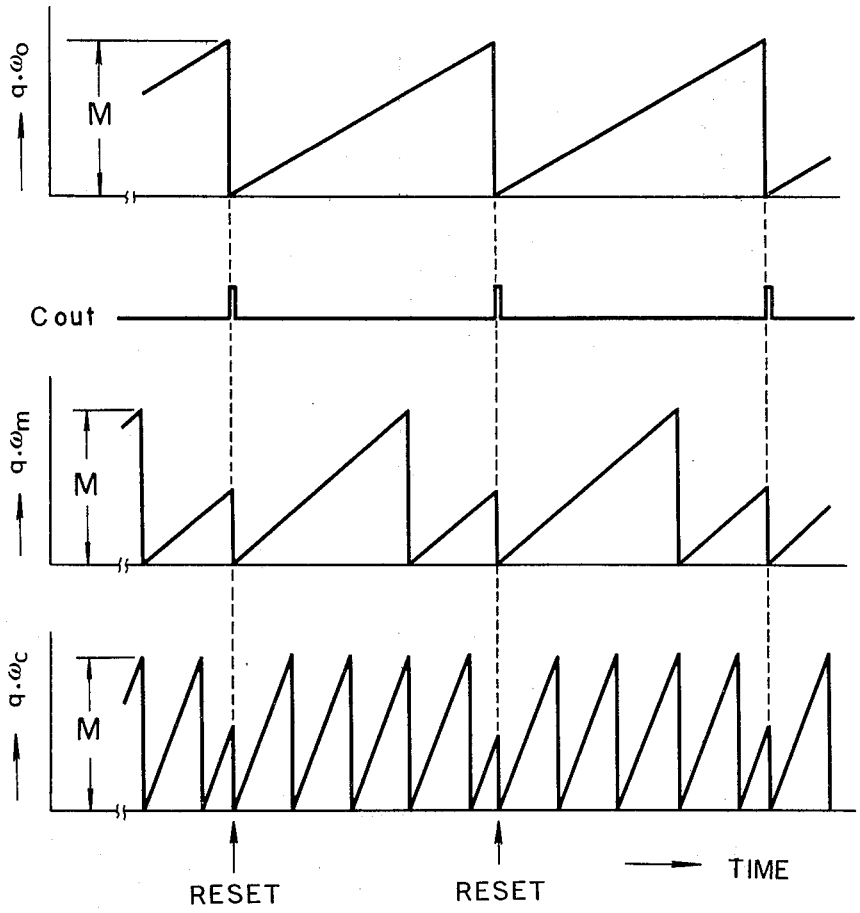
FIG. 8 is a diagram showing examples of outputs of respective portions of the circuit shown in FIG. 7.

Accumulators 12 and 13 perform the same function as those designated by the same reference numerals in FIG. 3. The accumulator 12 cumulatively adds frequency number $\omega_0$ representing the fundamental frequency of a note designated by depressed key and produces a carry out signal Cout. The accumulator 13 is reset by the carry out signal Cout. The accumulator 13 cumulatively adds data $\omega_f$ representing the formant center frequency and is periodically reset by the carry out signal Cout whereby the accumulator 13 produces phase angle data q.$\omega_c$ which is capable of synthesizing a carrier signal having a spectrum structure which is in harmonic relation with the fundamental frequency $\omega_0$ of the depressed key and in which a harmonic frequency i.$\omega_0$ nearest to the formant center frequency $\omega_f$ has the most emphasized level. The carry out signal Cout outputted by the accumulator 12 is applied not only to the accumulator 13 but to a reset input of the accumulator 23 to periodically reset the accumulated value q.$\omega_m$ in the accumulator 23 to a predetermined phase value (not necessarily 0 phase) in synchronism with the fundamental frequency $\omega_0$ of the depressed key. An example each of the accumulated value q.$\omega_0$ in the acumulator 12, the carry out signal Cout and the accumulated value q.$\omega_m$ and q $\omega_c$(q.$\omega_f$) in the accumulators 23 and 13 are shown in FIG. 8. It will be appreciated from FIG. 8 that the accumulated value q.$\omega_m$ of the accumulator 23, like the accumulated value q.$\omega_c$ in the accumulator 13, repeats increase within a range of a modulo number M unitl instant immediately before generation of the carry out signal Cout and, upon generation of the carry out signal Cout, is compulsorily reset to the initial phase even if the value q.$\omega_m$ has not reached the modulo number M.

By conducting the same resetting operation as in the accumulator 13, a periodical function established by phase angle data q.$\omega_m$ provided by the accumulator 23 is in harmonic relation with the fundamental frequency $\omega_0$ of the depressed key and the level of a harmonic frequency i.$\omega_0$ nearest to the fixed modulating frequency $\omega_m'$ is most emphasized for the same reason as was previously described. In other words, a modulating wave signal corresponding to this phase angle data q.$\omega_m$ has the harmonic frequency nearest to the ideal modulating frequency $\omega_m'$ as its principal component. The phase angle data q.$\omega_m$ outputted by the accumulator 23 is applied to an address of the sinusoidal wave table 15 (FIG. 3) in the frequency modulation circuit 14 as phase angle data of the modulating wave signal in the frequency modulation. The output q.$\omega_c$ of the accumulator 13 is applied, in the same manner as was previously described, to the adder 17(FIG. 3) as phase angle data of the carrier signal. In the embodiment shown in FIG. 7, the accumulated value q.$\omega_0$ of the accumulator 12 is not utilized in the frequency modulation.

By implementing the improvement shown in FIG. 7, the modulating frequency used in the frequency modulation for synthesizing a formant is not affected by variation in the fundamental frequency of the note designated by the depressed key. Assuming, for example, the ideal modulating frequency $\omega_m'$ is 2000 Hz, a principal component of the modulating frequency established by the output q.$\omega_m$ of the accumulator 23 when a key C7 (with a fundamental frequency 2093.005 Hz) is depressed is 2093.005 Hz, whereas a principal component of the modulating frequency when a key B2(with a fundamental frequency of 132.471 Hz) is depressed is a sixteenth harmonic of C7, i.e., 1975.533 Hz. As will be noted from this example, variation in frequency in the principal component of the modulating wave is insignificant and, accordingly, a constantly uniform fixed formant can be synthesized.

In the above described embodiments, description has been made with respect to a case wherein a single formant is employed. The invention is applicable to a case wherein a fixed formant consisting of a plurality of formants is to be synthesized. For example, a plurality of accumulators 12, 13 and 23 and frequency modulating circuit 14 may be provided in parallel in accordance with the number of formants to be synthesized simultaneously. More conveniently, the accumulators 12, 13 and 23 may be constructed in such a manner that they can perform a time division computation so that phase angle data ($q.\omega_m$, $q.\omega_c$ etc.) concerning respective formants can be computed on a time shared basis and, in accordance with such phase angle data computed on a time shared basis, the frequency modulation computation concerning the respective formant can be conducted on time shared basis in a single frequency modulation circuit 14. For convenience of the description, the invention has been described with respect to a case wherein it has been applied to a monophonic type electronic musical instrument. The invention, however, is not limited to this but is applicable to a polyphonic type of instrument. The frequency modulation circuit 14 is not limited to the construction illustrated in FIG. 3, but may be composed of any device that can conduct frequency modulation by utilizing the phase angle data $q.\omega_m$ of the modulating wave and the phase angle data $q.\omega_c$ of the carrier. Further, the accumulators 12, 13 and 23 in the above described embodiments repeat addition of a phase increment. These accumulators may be constructed in such a manner a phase decrement is repeatedly subtracted from a maximum value M corresponding to a predetermined modulo number. In this case, phase angle data equivalent to one obtained by the cumulative addition can be obtained.

What is claimed is:

1. An electronic musical instrument comprising:

note selection means for selecting a note among a plurality of notes;

phase generation means for generating phase angle data whose value varies at rate corresponding to a center frequency of a fixed formant, said fixed formant center frequency being independent of the frequency of the note selected by said note selection means;

reset means for repeatedly resetting the value of said phase angle data to a predetermined value with a frequency corresponding to the fundamental frequency of said selected note, said resetting continuing repeatedly while said note remains selected; and frequency modulation means for frequency-modulating said phase angle data according to a modulation signal and outputting a frequency modulated signal as a tone signal.

2. An electronic musical instrument as defined in claim 1 which further comprises formant selection means for generating a center frequency number having a value corresponding to said center frequency of said fixed formant and wherein said phase generation means comprises a first accumulator of a first modulo number which accumulates said center frequency number, said note selection means further for generating a fundamental frequency number having a value corresponding to said fundamental frequency of said selected note, and said reset means comprises a second accumulator of a second modulo number which accumulates said fundamental frequency number and outputs a carry out signal each time the accumulated value of said second accumulator has reached said second modulo number and said modulation signal whose value corresponds to said accumulated value of said second accumulator, said first accumulator being reset by said carry out signal.

3. An electronic musical instrument as defined in claim 1 further comprising:

modulation signal generating means for generating said modulation signal, and wherein said reset means further repeatedly resets the value of said modulation signal to an initial value with said frequency corresponding to said fundamental frequency of said selected note.

4. An electronic musical instrument as defined in claim 1 or 3 wherein said note selection means comprises a keyboard having a plurality of keys corresponding to said notes respectively, a key switch circuit for outputting a key signal representing a depressed key in said keyboard and a frequency number table for reading out a fundamental frequency number having a value corresponding to said fundamental frequency of said selected note in response to said key signal, said fundamental frequency number corresponding to the fundamental frequency of the note of said depressed key.

5. An electronic musical instrument as defined in claim 2 wherein said formant selection means comprises a formant selector for selecting a formant among a plurality or formants, said fixed formant being a selected formant by said formant selector and a formant center frequency number table which reads out said center frequency number in response to said fixed formant.

6. An electronic musical instrument as defined in claim 2 wherein said frequency modulation means comprises a first sinusoidal wave table for reading out a first sinusoidal wave signal in response to said modulation signal, a multiplier for multiplying said first sinusoidal wave signal with a modulation index, an adder for adding the output of said multiplier and the output of said first accumulator together, and a second sinusoidal wave table for reading out a second sinusoidal wave signal in response to the output of said adder thereby outputting said frequency modulated signal.

7. An electronic musical instrument as defined in claim 3 further comprises formant selection means for generating a center frequency number and a modulation frequency number, said center frequency number having a value corresponding to said center frequency and said modulation frequency number having a value determined by said fixed formant and wherein said phase generation means comprises a first accumulator of a first modulo number which accumulates said center frequency number, said note selection means comprises a frequency number table for generating a fundamental frequency number having a value corresponding to said fundamental frequency of said selected note, said reset means comprises a second accumulator of a second modulo number which accumulates said fundamental frequency number and outputs a carry out signal each time the accumulated value of said second accumulator has reached said second modulo number, and said modulation signal generating means comprises a third accumulator which accumulates said modulation frequency number, said third accumulator generating said modulation signal whose value corresponds to the accumulated value of said third accumulator, said first accumulator and said third accumulator being reset by said carry out signal.

8. An electronic musical instrument as defined in claim 7 said formant selection means comprises a formant selector for selecting a formant a plurality of formants, said fixed forment being a selected formant by said formant selector, a formant center frequency number table for reading out said center frequency number in accordance with said fixed formant, and a modulation frequency number table for reading out said modulation frequency number in accordance with said fixed formant.

9. An electronic musical instrument comprising:

note selection means for selecting a note among a plurality of notes;

modulating phase generation means for generating modulation phase angle data whose value varies at a rate corresponding to a modulating frequency;

reset means for repeatedly resetting the value of said modulation phase angle data to a predetermined value with a frequency corresponding to the fundamental frequency of the note selected by said note selection means, said resetting continuing repeatedly while said note remains selected; and frequency modulation means for effecting frequency modulation using said modulation phase angle data generated by said modulating phase generation means as phase angle data of a modulating wave to output a frequency modulated signal as a tone signal.

10. An electronic musical instrument as defined in claim 9 wherein said modulating phase generation means comprises a first accumulator of a first modulo number which repeatedly adds a constant corrresponding to said modulating frequency at a regular time interval, and said reset means comprises a second accumulator of a second modulo number which repeatedly adds a constant corresponding to said fundamental frequency at a regular time interval and outputs a carry out signal each time a result of the addition has reached said second modulo number, said first accumulator being reset by said carry out signal.

11. An electronic musical instrument as defined in claim 10 which further comprises carrier phase generation means for generating carrier phase angle data whose value varies at a rate corresponding to a center frequency of a desired fixed formant, said carrier phase angle data of said carrier phase generation means being also reset by said reset means.

12. An electronic musical instrument as defined in claim 11 which further comprises formant selection means and wherein said carrier phase generation means comprises a formant center frequency number table which reads out the constant corresponding to the center frequency of said fixed formant in response to the output of said formant selection means, and a third accumulator of a third modulo number which repeatedly adds a constant corresponding to said fixed formant center frequency of said fixed formant at a regular time interval;

said modulating phase generation means further comprises a modulating frequency number table for reading out a constant corresponding to said modulating frequency said modulating frequency determined by a formant selected by said formant selection means and supplying this constant to said first accumulator; and said frequency modulation means effects frequency modulation by using the output of said first accumulator as phase angle data of a modulating wave and the output of said third accumulator as phase angle data of a carrier.

13. In a digital tone generation system, the improvement for generating a tone having a fixed formant independent of the fundamental frequency of said generated tone, comprising:

first means for generating phase data and for establishing a carrier having a phase which corresponds to the value of said phase data, the value of said phase data itself varying periodically at a rate corresponding to the center frequency of said fixed formant, said phase data being reset to a fixed value at regular intervals corresponding to the period of said fundamental frequency of said generated tone, and modulation means for frequency modulating said carrier established by said phase data so as to produce said generated tone, said generated tone thereby including at least one harmonic near said center frequency.

14. A digital tone generation system according to claim 13 further comprising:

second means for generating second phase data of a modulating wave, the value of said second phase data itself varying periodically at a rate other than the fundamental frequency of said generated tone, said second phase data also being reset to a fixed value at said regular intervals, said modulation means frequency modulating said carrier with said modulating wave established by said second phase data.

15. An electronic musical instrument for generating a selected tone by frequency modulation of a carrier by a modulating wave, said selected tone having a fundamental frequency, comprising:

first means for generating a reset signal at regular intervals corresponding to the period of said fundamental frequency, second means for generating phase data of a wave, said phase data varying periodically at a fixed frequency independent of said fundamental frequency, said data being altered, by occurrence of said reset signal at said regular intervals, to a predetermined value from which said data thereafter continues to vary periodically at said fixed frequency until next being altered again, said instrument utilizing said phase data to establish one of said carrier and said modulating wave.

* * * * *